US011176951B2

(12) United States Patent
Pallone

(10) Patent No.: US 11,176,951 B2
(45) Date of Patent: Nov. 16, 2021

(54) PROCESSING OF A MONOPHONIC SIGNAL IN A 3D AUDIO DECODER, DELIVERING A BINAURAL CONTENT

(71) Applicant: ORANGE, Issy-les-Moulineaux (FR)

(72) Inventor: Gregory Pallone, Chatillon (FR)

(73) Assignee: ORANGE, Issy-les-Moulineaux (FR)

( * ) Notice: Subject to any disclaimer, the term of this patent is extended or adjusted under 35 U.S.C. 154(b) by 0 days.

(21) Appl. No.: 16/955,398

(22) PCT Filed: Dec. 7, 2018

(86) PCT No.: PCT/FR2018/053161

§ 371 (c)(1),
(2) Date: Jun. 18, 2020

(87) PCT Pub. No.: WO2019/122580

PCT Pub. Date: Jun. 27, 2019

(65) Prior Publication Data

US 2021/0012782 A1 Jan. 14, 2021

(30) Foreign Application Priority Data

Dec. 19, 2017 (FR) ..... 1762478

(51) Int. Cl.
*G10L 19/008* (2013.01)
*H04S 7/00* (2006.01)

(52) U.S. Cl.
CPC ..... *G10L 19/008* (2013.01); *H04S 7/304* (2013.01); *H04S 2400/01* (2013.01)

(58) Field of Classification Search
None
See application file for complete search history.

(56) References Cited

U.S. PATENT DOCUMENTS

2007/0213990 A1* 9/2007 Moon ..... H04S 3/008 704/500
2009/0299756 A1* 12/2009 Davis ..... G10L 19/008 704/500

(Continued)

OTHER PUBLICATIONS

English translation of the Written Opinion of the International Searching Authority dated Mar. 18, 2019 for corresponding International Application No. PCT/FR2018/053161, filed Dec. 7, 2018.

(Continued)

*Primary Examiner* — Qin Zhu
(74) *Attorney, Agent, or Firm* — David D. Brush; Westman, Champlin & Koehler, P.A.

(57) ABSTRACT

A method for processing a monophonic signal in a 3D audio decoder, including processing binauralizing decoded signals intended to be delivered spatially by a headset. The method is such that, on detection, in a datastream representative of the monophonic signal, of an indication of non-binauralization processing, which indication is associated with spatial delivery position information, the decoded monophonic signal is directed to a stereophonic rendering engine, which takes into account the position information to construct two delivery channels that are directly processed via a direct mixing that sums these two channels with a binauralized signal output from the binauralization processing, in order to be delivered via the headset. A decoder device that implements the processing method is also provided.

13 Claims, 5 Drawing Sheets

(56) References Cited

U.S. PATENT DOCUMENTS

| | | | | |
|---|---|---|---|---|
| 2010/0189281 | A1* | 7/2010 | Oh | G10L 19/008 381/94.1 |
| 2010/0191537 | A1* | 7/2010 | Breebaart | H04S 3/008 704/500 |
| 2011/0202355 | A1* | 8/2011 | Grill | G10L 19/18 704/500 |
| 2012/0177204 | A1* | 7/2012 | Hellmuth | G10L 19/008 381/22 |
| 2016/0266865 | A1 | 9/2016 | Tsingos et al. | |
| 2016/0300577 | A1 | 10/2016 | Fersch et al. | |

OTHER PUBLICATIONS

ISO/IEC 23008-3: "High efficiency 5 coding and media delivery in heterogenous environments—Part 3: 3D audio" published Jul. 25, 2014.

ETSI TS 103 190: "Digital Audio Compression Standard" published in Apr. 2014.

International Organisation for Standardisation Organisation Internationale De Normalisation, ISO/IEC JTC1/SC29/WG11, Coding of Moving Pictures and Audio, ISO/IEC JTC1/SC29/WG11/N11856, Jan. 2011.

International Organisation for Standardisation Organisation Internationale De Normalisation, ISO/IEC JTC1/SC29/WG11, Coding of Moving Pictures and Audio, ISO/IEC JTC1/SC29/WG11, MPEG2015/M37265, Oct. 2015.

Ville Pulkki, "Virtual Sound Source Positioning Using Vector Base Amplitude Panning", J. Audio Eng. Soc., vol. 45, No. 6, Jun. 1997.

International Organisation for Standardisation Organisation Internationale De Normalisation, ISO/IEC JTC1/SC29/WG11, Coding of Moving Pictures and Audio, ISO/IEC JTC1/SC29/WG11, N6428, Mar. 2004.

International Organisation for Standardisation Organisation Internationale De Normalisation, ISO/IEC JTC1/SC29/WG11, Coding of Moving Pictures and Audio, ISO/IEC JTC1/SC29/WG11, N14747, Aug. 2014.

International Search Report dated Mar. 6, 2019 for corresponding International Application No. PCT/FR2018/053161, filed Dec. 7, 2018.

Written Opinion of the International Searching Authority dated Mar. 6, 2019 for corresponding International Application No. PCT/FR2018/053161, filed Dec. 7, 2018.

* cited by examiner

PROCESSING OF A MONOPHONIC SIGNAL IN A 3D AUDIO DECODER, DELIVERING A BINAURAL CONTENT

CROSS-REFERENCE TO RELATED APPLICATIONS

This Application is a Section 371 National Stage Application of International Application No. PCT/FR2018053161, filed Dec. 7, 2018, the content of which is incorporated herein by reference in its entirety, and published as WO 2019/122580 on Jun. 27, 2019, not in English.

BACKGROUND OF THE DISCLOSURE

The present invention relates to the processing of an audio signal in a 3D-audio decoding system such as a codec meeting the MPEG-H 3D audio standard. The invention more particularly relates to the processing of a monophonic signal intended to be rendered by a headset that moreover receives binaural audio signals.

The term binaural designates rendering, by an audio headset or a pair of earphones, of an audio signal with, nevertheless, spatialization effects. Binaural processing of audio signals, called binauralization or binauralization processing below, uses HRTF (for head-related transfer function) filters in the frequency domain or HRIR, BRIR (for head-related impulse response, binaural room impulse response) filters in the time domain that reproduce the acoustic transfer functions between sound sources and the ears of the listener. These filters serve to simulate the auditory location clues that allow a listener to locate sound sources as though in real listening situations.

The signal for the right ear is obtained by filtering a monophonic signal with the transfer function (HRTF) of the right ear, and the signal for the left ear is obtained by filtering the same monophonic signal with the transfer function of the left ear.

In NGA (next generation audio) codecs such as MPEG-H 3D audio, which is described in the document referenced ISO/IEC 23008-3: "High efficiency coding and media delivery in heterogenous environments—Part 3: 3D audio" published 25 Jul. 2014, or even AC4, which is described in the document referenced ETSI TS 103 190: "Digital Audio Compression Standard" published in April 2014, the signals received by the decoder are initially decoded then undergo binauralization processing such as described above, before being rendered by an audio headset. The case in which the sound rendered by the audio headset is spatialized, i.e. in which a binauralized signal is employed, is the one of interest here.

The aforementioned codecs therefore lay the foundations for the possibility of rendering, by a plurality of virtual loud-speakers, of a binauralized signal that is listened to over a headset but also lay the foundations for the possibility of rendering, by a plurality of real loud-speakers, of a spatialized sound.

In certain cases, a function for tracking the head of the listener (head-tracking function) is associated with the binauralization processing, this function also being referred to as dynamic rendering, as opposed to static rendering. This type of processing allows the movement of the head of the listener to be taken into account, with a view to modifying the sound rendered to each ear so as to keep the rendering of the audio scene stable. In other words, the listener will perceive sound sources to be located in the same location in physical space whether he moves his head or not.

This may be important when viewing and listening to a 360° video content.

However, it is not desirable for certain contents to be processed with this type of processing. Specifically, in certain cases, when the content was created specifically for binaural rendering, for example if the signals were recorded directly using an artificial head or have already been processed with binauralization processing, then they must be rendered by the earphones of the headset directly. These signals do not require additional binauralization processing.

Likewise, a content producer may desire an audio signal to be rendered independently of the audio scene, i.e. for it to be perceived as a sound separate from the audio scene, for example in the case of a voice-off.

This type of rendering may for example allow explanations to be provided with the audio scene moreover being rendered. For example, the content producer may desire the sound to be rendered to a single ear, in order to be able to obtain a deliberate "earpiece" effect, i.e. for the sound to be heard only in one ear. It may also be desired for this sound to never be heard by the other ear, even if the listener moves his head, this being the case in the preceding example. The content producer may also desire this sound to be rendered at a precise position in the audio space, with respect to an ear of the listener (and not solely inside a single ear) even if the latter moves his head.

If such a monophonic signal were decoded and input into a rendering system such as an MPEG-H 3D audio or AC4 codec, it would be binauralized. The sound would then be distributed between the two ears (even though it would be quieter in the contralateral ear) and if the listener were to move his head, his ear would not perceive the sound in the same way, since head-tracking processing, if it is employed, will cause the position of the sound source to remain the same as in the initial audio scene: the loudness of the sound in each of the two ears will therefore appear to vary depending on the position of the head.

In one proposed amendment of the MPEG-H 3D audio standard, a contribution referenced "ISO/IEC JTC1/SC29/WG11 MPEG2015/M37265" of October 2015 proposes to identify contents that must not be altered by the binauralization.

Thus, a "dichotic" identification is associated with contents that must not be processed by binauralization.

All the audio elements will then be binauralized except those referenced "dichotic". "Dichotic" means that a different signal is fed to each of the ears.

In the same way, in the AC4 standard, a data bit indicates that a signal has already been virtualized. This bit allows post-processing to be disactivated. The contents thus identified are contents that are already formatted for the audio headset, i.e. binaural contents. They contain two channels.

These methods do not address the case of a monophonic signal for which the producer of the audio scene does not desire binauralization.

This prevents a monophonic signal from being rendered independently of the audio scene at a precise position with respect to an ear of a listener in what will be referred to as "earpiece" mode. Using prior-art two-channel techniques, one way of achieving a desired rendering to a single ear would be to create a 2-channel content consisting of a signal in one of the channels and in silence in the other channel, or indeed to create a stereophonic content taking into account the desired spatial position and to identify this content as having already been spatialized before transmitting it.

However, as this stereophonic content must be created, this type of processing creates complexity and requires additional bandwidth to transmit this stereophonic content.

There is therefore a need to provide a solution that allows a signal that will be rendered at a precise position with respect to an ear of an audio-headset wearer, independently of an audio scene rendered by the same headset, to be delivered while optimizing the bandwidth required by the codec used.

SUMMARY

The present invention aims to improve the situation.

To this end it proposes a method for processing an audio monophonic signal in a 3D audio decoder comprising a step of carrying out binauralization processing on decoded signals intended to be spatially rendered by an audio headset. The method is such that, on detecting, in a data stream representative of the monophonic signal, a non-binauralization-processing indication associated with rendering spatial position information, the decoded monophonic signal is directed to a stereophonic renderer that takes into account the position information to construct two rendering channels, which are processed with a direct mixing step that sums these two channels with a binauralized signal resulting from the binauralization processing, with a view to being rendered by the audio headset.

Thus, it is possible to specify that a monophonic content must be rendered at a precise spatial position with respect to an ear of a listener and for it not to undergo binauralization processing, so that this rendered signal can have an "earpiece" effect, i.e. be heard by the listener at a defined position with respect to one ear, inside his head, in the same way as a stereophonic signal and even if the head of the listener moves.

Specifically, stereophonic signals are characterized by the fact that each audio source is present in each of the 2 (left and right) output channels with a volume difference (or ILD for interaural level difference) and sometimes time difference (or ITD for interaural time difference) between the channels. When a stereophonic signal is listened to on a headset, the sources are perceived, inside the head of the listener, in a location positioned between the left ear and the right ear, that is dependent on the ILD and/or the ITD. Binaural signals differ from stereophonic signals in that a filter that reproduces the acoustic path from the source to the ear of the listener is applied to the sources. When a binaural signal is listened to on a headset, the sources are perceived outside of the head, in a location positioned on a sphere, depending on the filter used.

Stereophonic and binaural signals are similar in that they consist of 2 (left and right) channels and differ in the content of these 2 channels.

The rendered mono (for monophonic) signal is then superposed on the other rendered signals, which form a 3D audio scene.

The bandwidth necessary to indicate this type of content is optimized since it is enough to merely code an indication of position in the audio scene, in addition to the non-binauralization indication, to inform the decoder of the processing to be carried out, contrary to a method requiring a stereophonic signal taking into account this spatial position to be encoded, transmitted and then decoded.

The various particular embodiments mentioned below may be added, independently or in combination with one another, to the steps of the processing method defined above.

In one particular embodiment, the rendering spatial position information is a binary datum indicating a single channel of the rendering audio headset.

This information requires only one coding bit, this allowing the bandwidth required to be even further restricted.

In this embodiment, only the rendering channel corresponding to the channel indicated by the binary datum is summed with the corresponding channel of the binauralized signal in the direct mixing step, the value of the other rendering channel being null.

The summation thus performed is simple to implement and achieves the desired "earpiece" effect, of superposition of the mono signal on the rendered audio scene.

In one particular embodiment, the monophonic signal is a channel-type signal that is directed to the stereophonic renderer, with the rendering spatial position information.

Thus, the monophonic signal does not undergo the step in which binauralization processing is carried out and is not processed like the channel-type signals conventionally processed in prior-art methods. This signal is processed by a stereophonic renderer different from existing renderers used for channel-type signals. This renderer duplicates the monophonic signal on the 2 channels, but applies factors dependent on the rendering spatial position information to the two channels.

This stereophonic renderer may moreover be integrated into the channel renderer, with processing differentiated depending on detection applied to the signal input into this renderer, or into the direct mixing module that sums the channels generated by this stereophonic renderer with the binauralized signal generated by the module that carries out the binauralization processing.

In one embodiment associated with this channel-type signal, the rendering spatial position information is an ILD datum on interaural level difference or more generally information on the level ratio between the left and right channels.

In another embodiment, the monophonic signal is an object-type signal associated with a set of rendering parameters comprising the non-binauralization indication and the rendering position information, the signal being directed to the stereophonic renderer with the rendering spatial position information.

In this other embodiment, the rendering spatial position information is for example a datum on azimuthal angle.

This information allows a rendering position with respect to an ear of the wearer of the audio headset to be specified so that this sound is rendered superposed on an audio scene.

Thus, the monophonic signal does not undergo the step in which binauralization processing is carried out and is not processed like the object-type signals conventionally processed in prior-art methods. This signal is processed by a stereophonic renderer different from existing renderers used for object-type signals. The non-binauralization-processing indication and the rendering position information are comprised in the rendering parameters (metadata) associated with the object-type signal. This renderer may moreover be integrated into the object renderer, or into the direct mixing module that sums the channels generated by this stereophonic renderer with the binauralized signal generated by the module that carries out the binauralization processing.

The present invention also relates to a device for processing an audio monophonic signal comprising a module for carrying out binauralization processing on decoded signals intended to be spatially rendered by an audio headset. This device is such that it comprises:

a detecting module able to detect, in a data stream representative of the monophonic signal, a non-binauralization-processing indication associated with rendering spatial position information;

a module for redirecting, in the case of a positive detection by the detecting module, able to direct the decoded monophonic signal to a stereophonic renderer;

a stereophonic renderer able to take into account the position information to construct two rendering channels;

a direct mixing module able to directly process the two rendering channels by summing them with a binauralized signal generated by the module for carrying out binauralization processing, with a view to being rendered by the audio headset.

This device has the same advantages as the method described above, which it implements.

In one particular embodiment, the stereophonic renderer is integrated into the direct mixing module.

Thus, it is solely in the direct mixing module that the rendering channels are constructed, only the position information then being transmitted with the mono signal to the direct mixing module. This signal may be of channel type or of object type.

In one embodiment, the monophonic signal is a channel-type signal and the stereophonic renderer is integrated into a channel renderer that moreover constructs rendering channels for multi-channel signals.

In another embodiment, the monophonic signal is an object-type signal and the stereophonic renderer is integrated into an object renderer that moreover constructs rendering channels for monophonic signals associated with sets of rendering parameters.

The present invention relates to an audio decoder comprising a processing device such as described and to a computer program containing code instructions for implementing the steps of the processing method such as described, when these instructions are executed by a processor.

Lastly, the invention relates to an, optionally removable, processor-readable storage medium that may or may not be integrated into the processing device and that stores a computer program containing instructions for executing the processing method such as described above.

BRIEF DESCRIPTION OF THE DRAWINGS

Other features and advantages of the invention will become more clearly apparent on reading the following description, which is given merely by way of non-limiting example, with reference to the appended drawings, in which.

DETAILED DESCRIPTION OF ILLUSTRATIVE EMBODIMENTS

Figure 1:
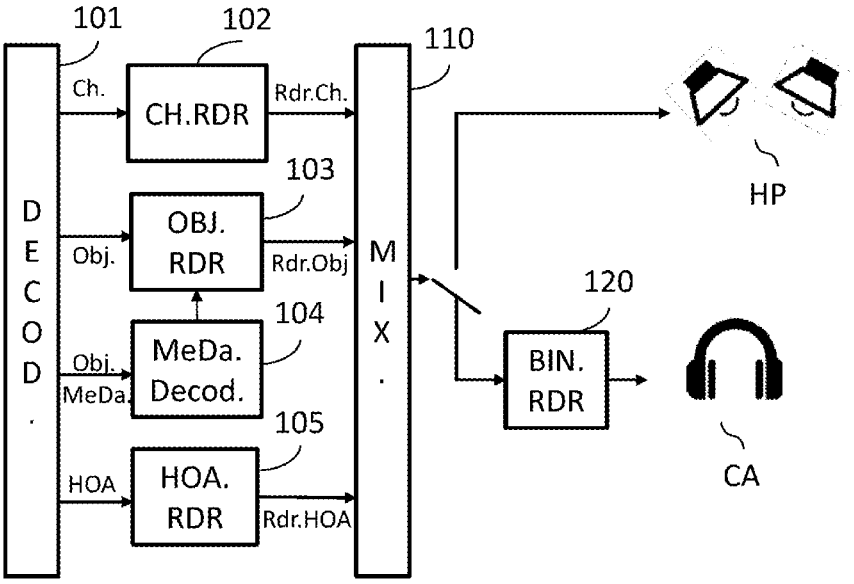
FIG. 1 (Prior art)
FIG. 1 illustrates an MPEG-H 3D audio decoder such as found in the prior art.

FIG. 1 schematically illustrates a decoder such as standardized in the MPEG-H 3D audio standard specified in the document referenced above. The block 101 is a core decoding module that decodes both multi-channel audio signals (Ch.) of "channel" type, monophonic audio signals (Obj.) of "object" type, which are associated with (metadata) spatialization parameters (Obj.MeDa.) and audio signals in HOA (for higher-order ambisonic) audio format.

A channel-type signal is decoded and processed by a channel renderer 102 (also called a "format converter" in the MPEG-H 3D audio standard) in order to adapt this channel signal to the audio rendering system. The channel renderer knows the characteristics of the rendering system and thus delivers one signal per rendering channel (Rdr.Ch) with a view to feeding either real loud-speakers or virtual loud-speakers (which will then be binauralized for rendering by the headset).

These rendering channels are mixed, by the mixing module 110, with other rendering channels generated by object and HOA renderers 103, 105 that are described below.

The object-type signals (Obj.) are monophonic signals associated with metadata such as spatialization parameters (azimuthal angles, elevation) that allow the monophonic signal to be positioned in the spatialized audio scene, priority parameters or audio volume parameters. This object signals and the associated parameters are decoded by the decoding module 101 and are processed by an object renderer 103 that, knowing the characteristics of the rendering system, adapts these monophonic signals to these characteristics. The various rendering channels (Rdr.Obj.) thus created are mixed with the other rendering channels generated by the channel and HOA renderers, by the mixing module 110.

In the same way, HOA (for higher-order ambisonic) signals are decoded and the decoded ambisonic components are input into an HOA renderer 105 in order to adapt these components to the audio rendering system.

The rendering channels (Rdr.HOA) created by this HOA renderer are mixed in 110 with the rendering channels created by the other renderers 102 and 103.

The signals output from the mixing module 110 may be rendered by real loud-speakers HP located in a rendering room. In this case, the signals output from the mixing module may be fed directly to these real loud-speakers, one channel corresponding to one loud-speaker.

In the case where the signals output from the mixing module are to be rendered by an audio headset CA, then these signals are processed by a module 120 for carrying out binauralization processing, using binauralization techniques such as for example described in the document cited with respect to the MPEG-H 3D audio standard.

Thus, all the signals intended to be rendered by an audio headset are processed by the module 120 for carrying out binauralization processing.

Figure 2:
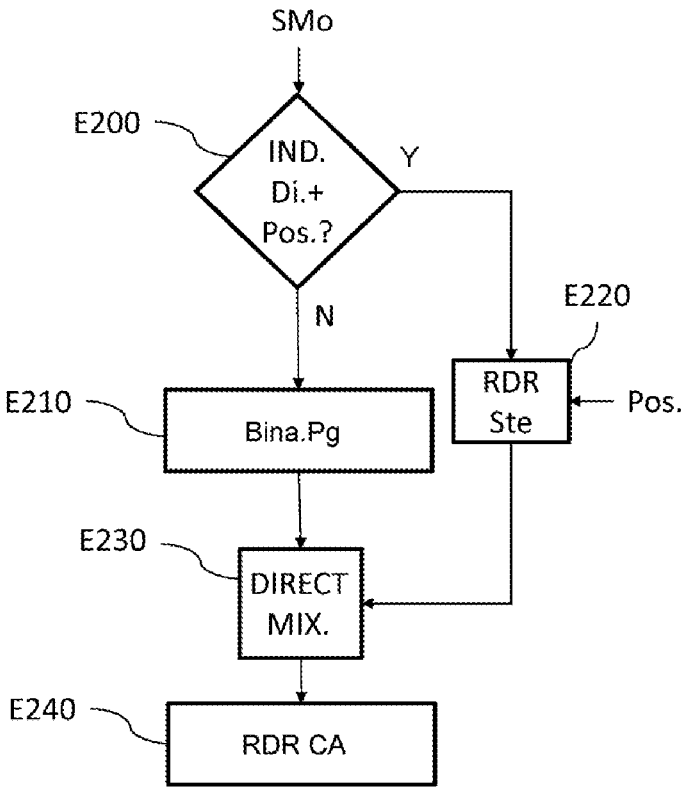
FIG. 2 illustrates the steps of a processing method according to one embodiment of the invention.

FIG. 2 illustrates the steps of a processing method according to one embodiment of the invention.

This method relates to the processing of a monophonic signal in a 3D-audio decoder. A step E200 detects whether the data stream (SMo) representative of the monophonic signal (for example the bitstream input into the audio decoder) comprises a non-binauralization indication associated with rendering spatial position information. In the contrary case (N in step E200) the signal must be binauralized. It is processed by carrying out binauralization processing, in step E210, before being rendered in E240 by a rendering audio headset. This binauralized signal may be mixed with other stereophonic signals generated in the step E220 described above.

In the case where the data stream representative of the monophonic signal comprises both a non-binauralization indication (Di.) and rendering spatial position information (Pos.) (Y in step E200), the decoded monophonic signal is directed to a stereophonic renderer to be processed in a step E220.

This non-binauralization indication may for example, as in the prior art, be a "dichotic" identification given to the monophonic signal or another identification understood as an instruction not to process the signal with binauralization processing. The rendering spatial position information may for example be an azimuthal angle indicating the rendering position of the sound with respect to a left or right ear, or even an indication of level difference between the left and right channels, such as ILD information allowing the energy of the monophonic signal to be distributed between the left and right channels, or even an indication that a single rendering channel, corresponding to the right or left ear, is to be used. In the latter case, this information is binary information that requires very little bandwidth (1 single data bit).

In step E220, the position information is taken into account to construct two rendering channels for the two earphones of the audio headset. These two rendering channels thus constructed are processed directly with a direct mixing step E230 that sums these two stereophonic channels with the two binauralized-signal channels resulting from the binauralization processing E210.

Each of the stereophonic rendering channels is then summed with the corresponding binauralized signal.

Following this direct mixing step, the two rendering channels generated in the mixing step E230 are rendered in E240 by the audio headset CA.

In the embodiment in which the rendering spatial position information is a binary datum indicating a single channel of the rendering audio headset, this means that the monophonic signal must be rendered solely by one earphone of this headset. The two rendering channels constructed in step E220 by the stereophonic renderer therefore consist of one channel comprising the monophonic signal, the other being null, and therefore possibly absent.

In the direct mixing step E230, a single channel is therefore summed with the corresponding channel of the binauralized signal, the other channel being null. This mixing step is therefore simplified.

Thus, a listener wearing the audio headset hears, on the one hand, a spatialized audio scene generated from the binauralized signal (in the case of dynamic rendering, the physical layout of the audio scene heard by the listener remains the same even if he moves his head) and, on the other hand, a sound positioned inside his head, between one ear and the center of his head, which is independently superposed on the audio scene, i.e. if the listener moves his head, this sound will be heard in the same position with respect to one ear.

This sound is therefore perceived to be superposed on the other binauralized sounds of the audio scene, and will for example function as a voice-off in this audio scene.

The "earpiece" effect is thus achieved.

Figure 3:
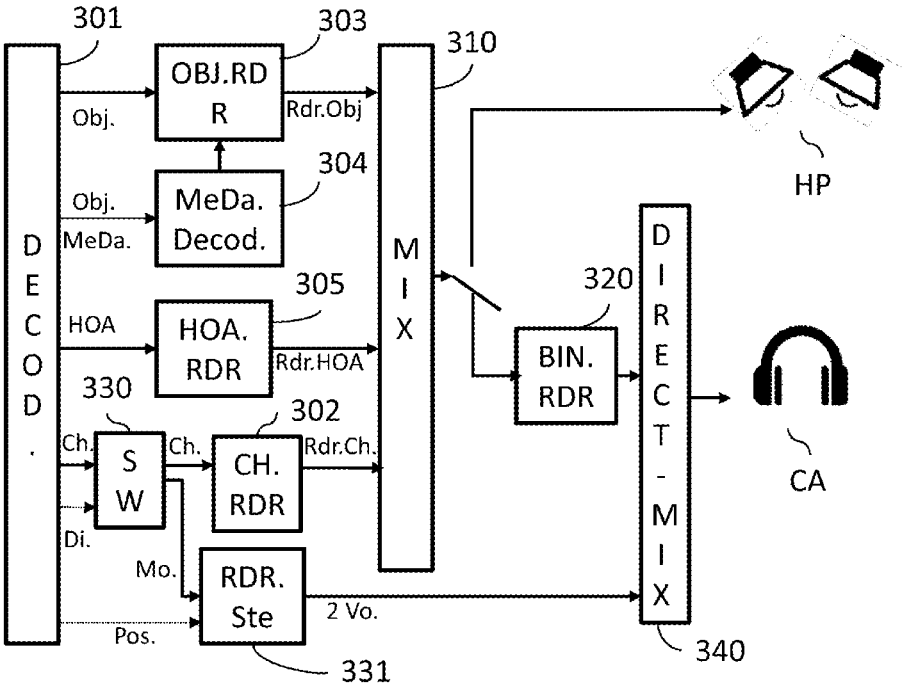
FIG. 3 illustrates a decoder comprising a processing device according to a first embodiment of the invention.

FIG. 3 illustrates a first embodiment of a decoder comprising a processing device that implements the processing method described with reference to FIG. 2. In this example embodiment, the monophonic signal processed by the implemented process is a channel-type signal (Ch.).

Object-type signals (Obj.) and HOA-type signals (HOA) are processed by respective blocks 303, 304 and 305 in the same way as for blocks 103, 104 and 105 described with reference to FIG. 1. In the same way, the mixing block 310 performs mixing such as described with respect to block 110 of FIG. 1.

The block 330, which receives channel-type signals, processes a monophonic signal comprising a non-binauralization indication (Di.) associated with rendering position spatial information (Pos.) differently from another signal not containing these pieces of information, in particular a multichannel signal. As regards these signals not containing these pieces of information, they are processed by the block 302 in the same way as in the block 102 described with reference to FIG. 1.

For a monophonic signal containing the non-binauralization indication associated with rendering spatial position information, the block 330 acts as a router or switch and directs the decoded monophonic signal (Mo.) to a stereophonic renderer 331. The stereophonic renderer moreover receives, from the decoding module, rendering spatial position information (Pos.). With this information, it constructs two rendering channels (2 Vo.), corresponding to the left and right channels of the rendering audio headset, so that these channels may be rendered by the audio headset CA. In one example embodiment, the rendering spatial position information is information on the interaural level difference between the left and right channels. This information allows the factor that must be applied to each of the rendering channels to achieve this rendering spatial position to be defined.

These factors may be defined as in the document referenced MPEG-2 AAC: ISO/IEC 13818-4:2004/DCOR 2, AAC in section 7.2 describing intensity stereo.

Before being rendered by the audio headset, these rendering channels are added to the channels of a binauralized signal generated by the binauralization module 320, which performs binauralization processing in the same way as the block 120 of FIG. 1.

This step of summing the channels is performed by the direct mixing module 340, which sums the left channel generated by the stereophonic renderer 331 with the left channel of the binauralized signal generated by the binauralization processing module 320 and the right channel generated by the stereophonic renderer 331 with the right channel of the binauralized signal resulting from the binauralization processing module 320, before rendering by the headset CA.

Thus, the monophonic signal does not pass through the binauralization processing module 320: it is transmitted directly to the stereophonic renderer 331 before being mixed directly with a binauralized signal.

This signal will therefore also not undergo head-tracking processing. The sound rendered will therefore be at a rendering position with respect to one ear of the listener and will remain in this position even if the listener moves his head.

In this embodiment, the stereophonic renderer 331 may be integrated into the channel renderer 302. In this case, this channel renderer implements both the adaptation of conventional channel-type signals, as described with reference to FIG. 1, and the construction of the two rendering channels of the renderer 331, as explained above, when rendering spatial position information (Pos.) is received. Only the two rendering channels are then redirected to the direct mixing module 340 before rendering by the audio headset CA.

In one variant embodiment, the stereophonic renderer 331 is integrated into the direct mixing module 340. In this case, the routing module 330 directs the decoded monophonic signal (for which it has detected the non-binauralization indication and the rendering spatial position information) to the direct mixing module 340. Furthermore, the decoded rendering spatial position information (Pos.) is also transmitted to the direct mixing module 340. Since this direct mixing module then comprises the stereophonic renderer, it implements the construction of the two rendering channels taking into account the rendering spatial position information and the mixing of these two rendering channels with the rendering channels of a binauralized signal generated by the binauralization processing module 320.

Figure 4:
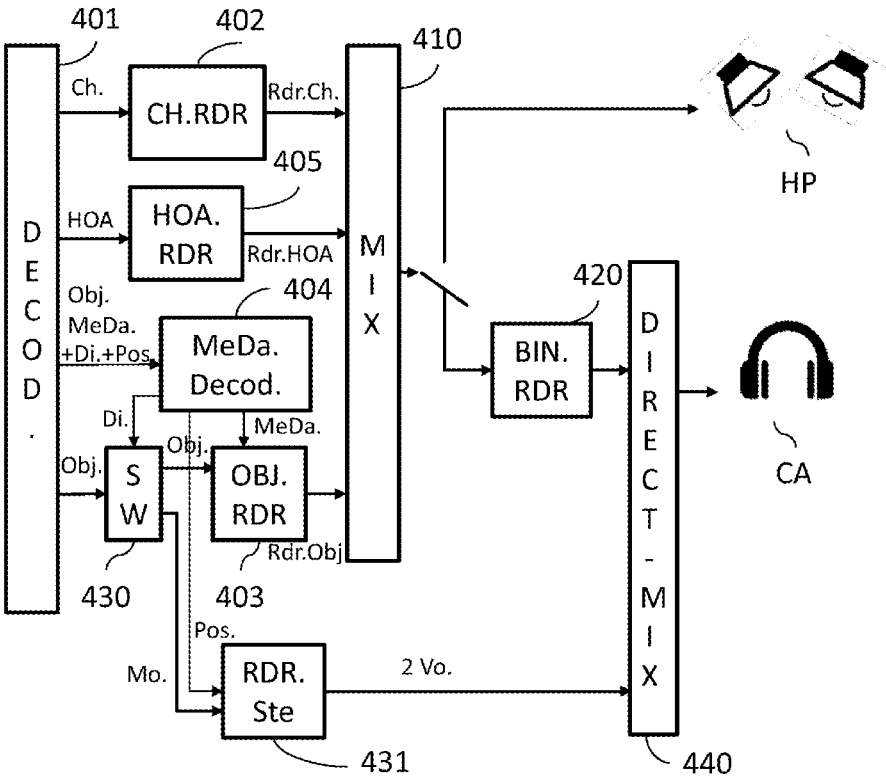
FIG. 4 illustrates a decoder comprising a processing device according to a second embodiment of the invention.

FIG. 4 illustrates a second embodiment of a decoder comprising a processing device that implements the processing method described with reference to FIG. 2. In this example embodiment, the monophonic signal processed using the implemented process is an object-type signal (Obj.).

Channel-type signals (Ch.) and HOA-type signals (HOA) are processed by respective blocks 402 and 405 in the same way as for blocks 102 and 105 described with reference to FIG. 1. In the same way, the mixing block 410 performs mixing such as described with respect to block 110 of FIG. 1.

The block 430, which receives object-type signals (Obj.), processes a monophonic signal for which a non-binauralization indication (Di.) associated with rendering position spatial information (Pos.) has been detected differently from another monophonic signal for which these pieces of information have not been detected.

As regards monophonic signals for which these pieces of information have not been detected, they are processed by the block 403 in the same way as in the block 103 described with reference to FIG. 1, using the parameters decoded by the block 404, which decodes metadata in the same way as the block 104 of FIG. 1.

For a monophonic signal of object type for which the non-binauralization indication associated with rendering spatial position information has been detected, the block 430 acts as a router or switch and directs the decoded monophonic signal (Mo.) to a stereophonic renderer 431.

The non-binauralization indication (Di.) and the rendering spatial position information (Pos.) are decoded by the block 404 for decoding the metadata or parameters associated with object-type signals. The non-binauralization indication (Di.) is transmitted to the routing block 430 and the rendering spatial position information is transmitted to the stereophonic renderer 431.

This stereophonic renderer, which thus receives rendering spatial position information (Pos.) constructs two rendering channels, corresponding to the left and right channels of the rendering audio headset, so that these channels may be rendered by the audio headset CA.

In one example embodiment, the rendering spatial position information is information on azimuthal angle defining an angle between the desired rendering position and the center of the head of the listener.

This information allows the factor that must be applied to each of the rendering channels to achieve this rendering spatial position to be defined.

The gain factors for the left and right channels may be computed in the way presented in the document entitled "Virtual Sound Source Positioning Using Vector Base Amplitude Panning" by Ville Pulkki in J. Audio Eng. Soc., Vol. 45, No. 6, June 1997.

For example, the gain factors of the stereophonic renderer may be given by:

$$g1=(\cos O.\sin H+\sin O.\cos H)/(2.\cos H.\sin H)$$

$$g2=(\cos O.\sin H-\sin O.\cos H)/(2.\cos H.\sin H)$$

where g1 and g2 correspond to the factors for the signals of the left and right channels, O is the angle between the frontal direction and the object (referred to as azimuth), and H is the angle between the frontal direction and the position of the virtual loud-speaker (corresponding to the half-angle between the loud-speakers), which is for example set to 45°.

Before being rendered by the audio headset, these rendering channels are added to the channels of a binauralized signal generated by the binauralization module 420, which performs binauralization processing in the same way as the block 120 of FIG. 1.

This step of summing the channels is performed by the direct mixing module 440, which sums the left channel generated by the stereophonic renderer 431 with the left channel of the binauralized signal generated by the binauralization processing module 420 and the right channel generated by the stereophonic renderer 431 with the right channel of the binauralized signal resulting from the binauralization processing module 420, before rendering by the headset CA.

Thus, the monophonic signal does not pass through the binauralization processing module 420: it is transmitted directly to the stereophonic renderer 431 before being mixed directly with a binauralized signal.

This signal will therefore also not undergo head-tracking processing. The sound rendered will therefore be at a rendering position with respect to one ear of the listener and will remain in this position even if the listener moves his head.

In this embodiment, the stereophonic renderer 431 may be integrated into the object renderer 403. In this case, this object renderer implements both the adaptation of conventional object-type signals, as described with reference to FIG. 1, and the construction of the two rendering channels of the renderer 431, as explained above, when rendering spatial position information (Pos.) is received from the parameter-decoding module 404. Only the two rendering channels (2Vo.) are then redirected to the direct mixing module 440 before rendering by the audio headset CA.

In one variant embodiment, the stereophonic renderer 431 is integrated into the direct mixing module 440. In this case, the routing module 430 directs the decoded monophonic signal (Mo.) (for which it has detected the non-binauralization indication and the rendering spatial position information) to the direct mixing module 440. Furthermore, the decoded rendering spatial position information (Pos.) is also transmitted to the direct mixing module 440 by the parameter-decoding module 404. Since this direct mixing module then comprises the stereophonic renderer, it implements the construction of the two rendering channels taking into account the rendering spatial position information and the mixing of these two rendering channels with the rendering channels of a binauralized signal generated by the binauralization processing module 420.

Figure 5:
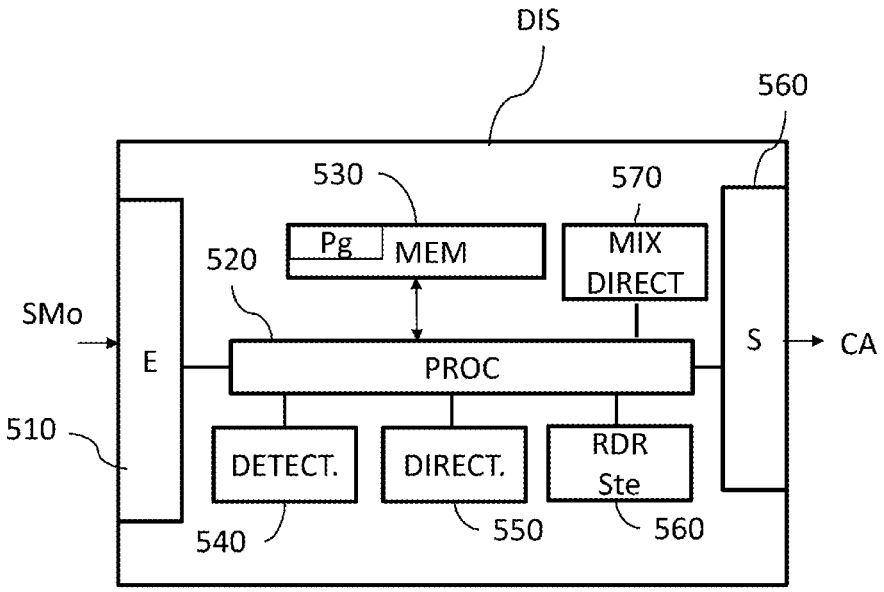
FIG. 5 illustrates a hardware representation of a processing device according to one embodiment of the invention.

Now, FIG. 5 illustrates an example of a hardware embodiment of a processing device able to implement the processing method according to the invention.

The device DIS comprises a storage space 530, for example a memory MEM, and a processing unit 520 that comprises a processor PROC, which is controlled by a computer program Pg, which is stored in the memory 530, and that implements the processing method according to the invention.

The computer program Pg contains code instructions for implementing the steps of the processing method according to the invention, when these instructions are executed by the processor PROC, and, in particular, on detecting, in a data stream representative of the monophonic signal, a non-binauralization-processing indication associated with rendering spatial position information, a step of directing the decoded monophonic signal to a stereophonic renderer that takes into account the position information to construct two rendering channels, which are directly processed with a direct mixing step that sums these two channels with a binauralized signal resulting from the binauralization processing, with a view to being rendered by the audio headset.

Typically, the description of FIG. 2 applies to the steps of an algorithm of such a computer program.

On initialization, the code instructions of the program Pg are for example loaded into a RAM (not shown) before being executed by the processor PROC of the processing unit 520. The program instructions may be stored in a storage medium such as a flash memory, a hard disk or any other non-transient storage medium.

The device DIS comprises a receiving module 510 able to receive a data stream SMo in particular representative of a monophonic signal. It comprises a detecting module 540 able to detect, in this data stream, a non-binauralization-processing indication associated with rendering spatial position information. It comprises a module 550 for directing, in the case of a positive detection by the detecting module 540, the decoded monophonic signal to a stereophonic renderer 560, the stereophonic renderer 560 being able to take into account the position information to construct two rendering channels.

The device DIS also comprises a direct mixing module 570 able to directly process the two rendering channels by summing them with the two channels of a binauralized signal generated by a binauralization processing module. The rendering channels thus obtained are transmitted to an audio headset CA via an output module 560, to be rendered.

Embodiments of these various modules are such as described with reference to FIGS. 3 and 4.

The term module may correspond either to a software component or to a hardware component or to an assembly of hardware and software components, a software component itself corresponding to one or more computer programs or subroutines or more generally to any element of a program able to implement a function or a set of functions such as described for the modules in question. In the same way, a hardware component corresponds to any element of a hardware assembly able to implement a function or a set of functions for the module in question (integrated circuit, chip card, memory card, etc.).

The device may be integrated into an audio decoder such as illustrated in FIG. 3 or 4, and may for example be integrated into multimedia equipment such as a set-top box or a reader of audio or video content. They may also be integrated into communication equipment such as a cell phone or a communication gateway.

Although the present disclosure has been described with reference to one or more examples, workers skilled in the art will recognize that changes may be made in form and detail without departing from the scope of the disclosure and/or the appended claims.

The invention claimed is:

1. A method for processing an audio monophonic signal in a 3D audio decoder comprising:

carrying out binauralization processing on decoded signals to be spatially rendered by an audio headset, wherein the processing comprises:

on detecting, in a data stream representative of the monophonic signal, a non-binauralization-processing indication associated with rendering spatial position information, directing the decoded monophonic signal to a stereophonic renderer and/or a direct mixing module that takes into account the position information to construct first and second rendering channels, which are directly processed with a direct mixing that sums the first and second rendering channels with a binauralized signal resulting from the binauralization processing, with a view to being rendered by the audio headset.

2. The method as claimed in claim 1, wherein the rendering spatial position information is a binary datum indicating a single channel of the rendering audio headset.

3. The method as claimed in claim 2, wherein only the rendering channel corresponding to the channel indicated by the binary datum is summed with the corresponding channel of the binauralized signal in the direct mixing, the value of the other rendering channel being null.

4. The method as claimed in claim 1, wherein the monophonic signal is a channel-type signal that is directed to the stereophonic renderer and/or the direct mixing module, with the rendering spatial position information.

5. The method as claimed in claim 4, wherein the rendering spatial position information is a datum on interaural level difference (ILD).

6. The method as claimed in claim 1, wherein the monophonic signal is an object-type signal associated with a set of rendering parameters comprising the non-binauralization indication and the rendering position information, the signal being directed to the stereophonic renderer and/or the direct mixing module with the rendering position information.

7. The method as claimed in claim 6, wherein the rendering spatial position information is a datum on azimuthal angle.

8. A device for processing an audio monophonic signal, wherein the device comprises:

a processor; and a non-transitory computer-readable medium comprising instructions stored thereon, which when executed by the processor configure the device to:

carry out binauralization processing on decoded signals to be spatially rendered by an audio headset;

detect, in a data stream representative of the monophonic signal, a non-binauralization-processing indication associated with rendering spatial position information;

in response to a positive detection of the non-binauralization-processing indication, direct the decoded monophonic signal to a stereophonic renderer and/or a direct mixing module;

stereophonic rendering the decoded monophonic signal by the stereophonic renderer which takes into account the position information to construct first and second rendering channels; and directly mix by directly processing the first and second rendering channels by summing them with a binauralized signal generated by the binauralization processing, with a view to being rendered by the audio headset.

9. The processing device as claimed in claim 8, wherein the stereophonic renderer is integrated into the direct mixing module that performs the direct mixing.

10. The device as claimed in claim 8, wherein the monophonic signal is a channel-type signal and wherein the stereophonic renderer is integrated into a channel renderer that moreover constructs rendering channels for multi-channel signals.

11. The device as claimed in claim 8, wherein the monophonic signal is an object-type signal and wherein the stereophonic renderer is integrated into an object renderer that moreover constructs rendering channels for monophonic signals associated with sets of rendering parameters.

12. The device according to claim 8, wherein the device is incorporated in an audio decoder.

13. A non-transitory processor-readable storage medium that stores a computer program containing instructions for executing a method for processing an audio monophonic signal in a 3D audio decoder when the instructions are executed by a processor, wherein the instructions configure the processor to:

carry out a binauralization processing on decoded signals to be spatially rendered by an audio headset, wherein the processing comprises:

on detecting, in a data stream representative of the monophonic signal, a non-binauralization-processing indication associated with rendering spatial position information, directing the decoded monophonic signal to a stereophonic renderer and/or a direct mixing module that takes into account the position information to construct first and second rendering channels, which are directly processed with a direct mixing that sums the first and second rendering channels with a binauralized signal resulting from the binauralization processing, with a view to being rendered by the audio headset.

* * * * *